US005842594A

United States Patent [19]

Ibara

[11] Patent Number: 5,842,594

[45] Date of Patent: Dec. 1, 1998

[54] SEALING DEVICE FOR OPENED CANS

[76] Inventor: Shirley Ibara, 2085 S. Breezy Point Rd., Stanwood, Wash. 98292

[21] Appl. No.: 796,937

[22] Filed: Feb. 7, 1997

[51] Int. Cl.[6] ..... B65D 45/28

[52] U.S. Cl. ..... 220/314; 220/793

[58] Field of Search ..... 220/243, 251, 220/254, 258, 314, 780, 784, 789, 791, 793, 906

[56] References Cited

U.S. PATENT DOCUMENTS

| | | | |
|---|---|---|---|
| 3,325,044 | 6/1967 | McCutcheon | 220/730 X |
| 3,680,732 | 8/1972 | Dickie | 220/314 |
| 3,913,779 | 10/1975 | Blazer et al. | 220/243 |
| 3,984,026 | 10/1976 | Shoup | 220/278 |
| 4,387,826 | 6/1983 | Heubl | 220/243 |
| 4,511,057 | 4/1985 | Tontarelli | 220/306 |
| 5,501,357 | 3/1996 | Fullin | 220/325 |

FOREIGN PATENT DOCUMENTS

| | | | |
|---|---|---|---|
| 1392232 | 4/1975 | United Kingdom | 220/251 |

*Primary Examiner*—Stephen K. Cronin

[57] ABSTRACT

A sealing device for opened cans including an elongated strip dimensioned for placement over the top of and engaging a rim of the beverage can. A plug is secured to a lower surface of the elongated strip inwardly of one of opposing end portions of the elongated strip whereby when the elongated strip is secured to the top of the beverage can, the plug is sealingly disposed over an opening in the top thereby precluding the unwanted escape of carbonation from the liquid.

1 Claim, 3 Drawing Sheets

SEALING DEVICE FOR OPENED CANS

BACKGROUND OF THE INVENTION

1. Field of the Invention

The present invention relates to a sealing device for opened cans and more particularly pertains to preserving carbonation and preventing spillage with a sealing device for opened cans.

2. Description of the Prior Art

The use of container covers is known in the prior art. More specifically, container covers heretofore devised and utilized for the purpose of covering containers are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,139,163 to Diaz discloses a hygienic seal and cover for food and drink containers.

U.S. Pat. No. 4,917,258 to Boyd et al. discloses a snap-on lid for opened soft drink cans.

U.S. Pat. No. 5,176,278 to Quarberg discloses a beverage can resealing device.

U.S. Pat. No. 4,915,252 to Schaffer discloses a beverage can stopper.

U.S. Pat. No. 4,925,051 to Herbet discloses a push and drink lid with pour spout.

While these devices fulfill their respective, particular objective and requirements, the aforementioned patents do not describe a sealing device for opened cans for preserving carbonation and preventing spillage.

In this respect, the sealing device for opened cans according to the present invention substantially departs from the conventional concepts and designs of the prior art, and in doing so provides an apparatus primarily developed for the purpose of preserving carbonation and preventing spillage.

Therefore, it can be appreciated that there exists a continuing need for new and improved sealing device for opened cans which can be used for preserving carbonation and preventing spillage. In this regard, the present invention substantially fulfills this need.

SUMMARY OF THE INVENTION

In the view of the foregoing disadvantages inherent in the known types of container covers now present in the prior art, the present invention provides an improved sealing device for opened cans. As such, the general purpose of the present invention, which will be described subsequently in greater detail, is to provide a new and improved sealing device for opened cans and method which has all the advantages of the prior art and none of the disadvantages.

To attain this, the present invention essentially comprises an elongated strip having opposing end portions and a central extent. The elongated strip has a width gradually increasing from the central extent outwardly to the opposing end portions. The opposing end portions each have inwardly curved lips having a generally U-shaped cross-section. The elongated strip has a width essentially equal to a diameter of a top of a cylindrical beverage can. The elongated strip is dimensioned for placement over the top of the beverage can with the inwardly curved lips snapidly engaging a rim of the top of the beverage can. The device includes a rubber plug having a generally circular configuration. The plug has an upper surface and a lower surface. The plug is secured to a lower surface of the elongated strip inwardly of one of the opposing end portions whereby when the elongated strip is secured to the top of the beverage can, the plug is sealingly disposed over an opening in the top. A lifting tab is integrally formed with and extending outwardly from one of the inwardly curved lips adjacent to the rubber plug. The lifting tab facilitates engagement and disengagement of the device from the beverage can.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sealing device for opened cans which has all the advantages of the prior art container covers and none of the disadvantages.

It is another object of the present invention to provide a new and improved sealing device for opened cans which may be easily and efficiently manufactured and marketed.

It is a further object of the present invention to provide a new and improved sealing device for opened cans which is of durable and reliable construction.

An even further object of the present invention is to provide a new and improved sealing device for opened cans which is susceptible of a low cost of manufacture with regard to both materials and labor, and which accordingly is then susceptible of low prices of sale to the consuming public, thereby making such a sealing device for opened cans economically available to the buying public.

Even still another object of the present invention is to provide a new and improved sealing device for opened cans for preserving carbonation and preventing spillage.

Lastly, it is an object of the present invention to provide a new and improved sealing device for opened cans including an elongated strip dimensioned for placement over the top of and engaging a rim of the beverage can. A plug is secured to a lower surface of the elongated strip inwardly of one of opposing end portions of the elongated strip whereby when the elongated strip is secured to the top of the beverage can, the plug is sealingly disposed over an opening in the top thereby precluding the unwanted escape of carbonation from the liquid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
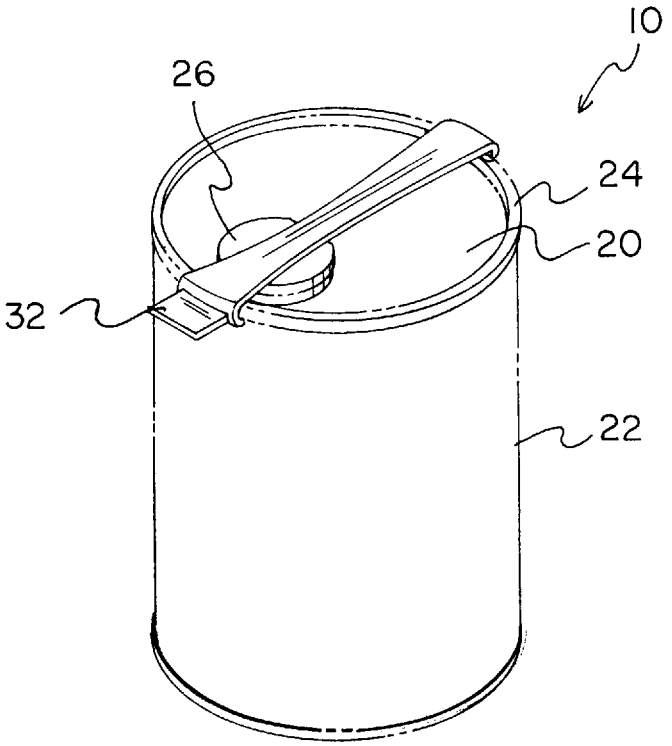
FIG. 1 is a plan perspective view of the preferred embodiment of the sealing device for opened cans constructed in accordance with the principles of the present invention.
Figure 2:
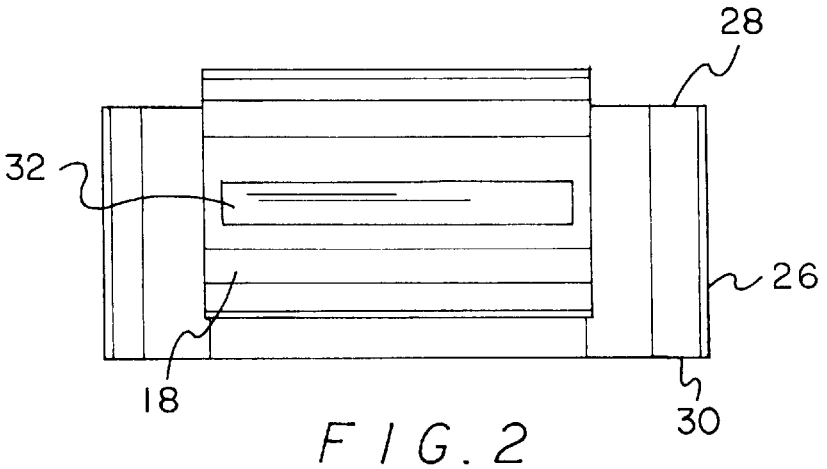
FIG. 2 is a front elevation view of the present invention.
Figure 3:
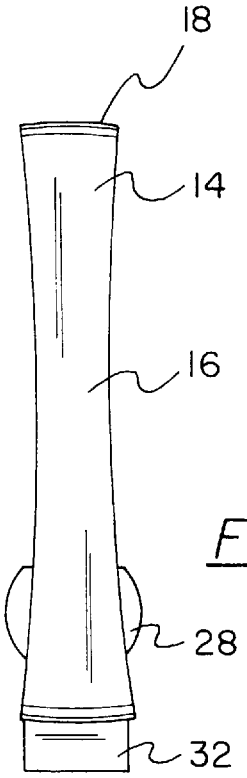
FIG. 3 is a top plan view of the present invention illustrated in FIGS. 1 and 2.
Figure 4:
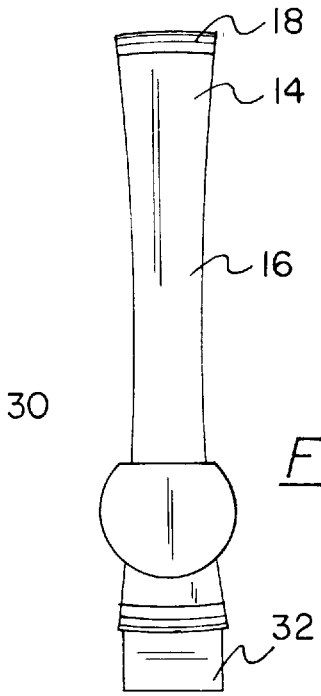
FIG. 4 is a bottom plan view of the present invention illustrated in FIG. 3.
Figure 5:
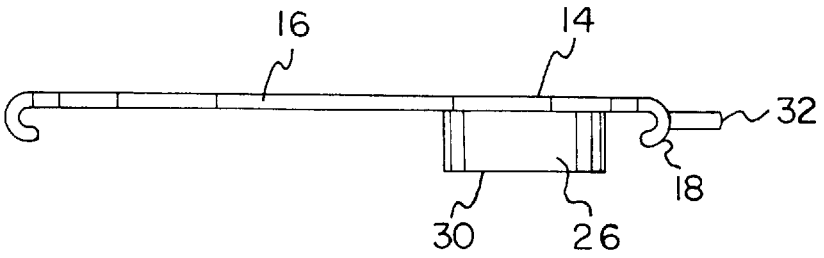
FIG. 5 is a side elevation view of the present invention.
Figure 6:
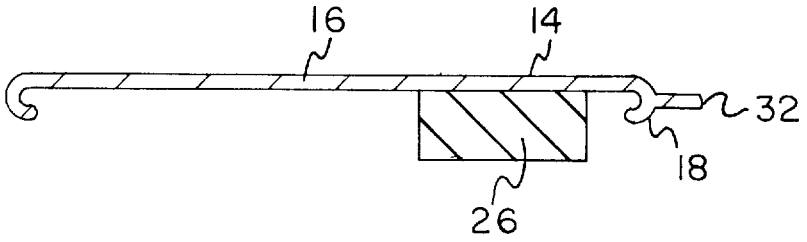
FIG. 6 is a cross-sectional side view of the present invention illustrated in FIG. 5.

With reference now to the drawings, and in particular, to FIGS. 1 through 6 thereof, the preferred embodiment of the new and improved sealing device for opened cans embodying the principles and concepts of the present invention and generally designated by the reference number 10 will be described.

Specifically, it will be noted in the various Figures that the device relates to a sealing device for opened cans for preserving carbonation and preventing spillage. In its broadest context, the device consists of an elongated strip, a rubber plug and a lifting tab. Such components are individually configured and correlated with respect to each other so as to attain the desired objective.

The device 10 includes an elongated strip 12 having opposing end portions 14 and a central extent 16. The elongated strip 12 has a width gradually increasing from the central extent 16 outwardly to the opposing end portions 14. The opposing end portions 14 each have inwardly curved lips 18 having a generally U-shaped cross-section. The elongated strip 12 has a width essentially equal to a diameter of a top 20 of a cylindrical beverage can 22. The elongated strip 12 is dimensioned for placement over the top 20 of the beverage can 22 with the inwardly curved lips 18 snapidly engaging a rim 24 of the top 20 of the beverage can 22. The elongated strip 12 is preferably fabricated of a metal or plastic material.

In association with the elongated strip 12, the device 10 includes a rubber plug 26. The rubber plug 26 has a generally circular configuration. The plug 26 has an upper surface 28 and a lower surface 30. The plug 26 is secured to a lower surface 30 of the elongated strip 12 inwardly of one of the opposing end portions 14 whereby when the elongated strip 12 is secured to the top 20 of the beverage can 22, the plug 26 is sealingly disposed over an opening in the top 22. The rubber plug 26 serves to contain the carbonation within the can 22 and also prevents spillage.

A lifting tab 32 is integrally formed with and extends outwardly from one of the inwardly curved lips 18 adjacent to the rubber plug 26. The lifting tab 32 facilitates engagement and disengagement of the device 10 from the beverage can 22. The lifting tab 32 is fabricated of a material consistent with the fabrication of the elongated strip 12.

The device 10 is a snap-on sealing device to use on opened aluminum beverage cans to help preserve carbonation and prevent spills.

The device 10 is a clip or strip 12 of metal or plastic with a synthetic rubber seal 26 attached that is made to fit into the opening of the can 22. The elongated strips features a curved lip 18 at one side that grabs one edge of the can 22 and an opposing curved lip 18 that will flex sufficiently to slip down over the opposite edge of the can 22 and secure the device 10 with spring pressure.

The device 10 can also be imprinted with indicia across an upper surface of the elongated strip 12. Such indicia could include corporate logos or slogans for advertising or promotional purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A sealing device for opened cans for preserving carbonation and preventing spillage comprising, in combination:

a plastic flexible elongated strip with indicia printed thereon and having opposing end portions and a central extent, the elongated strip having a width gradually increasing from the central extent outwardly and symmetrically to the opposing end portions, the opposing end portions each having inwardly curved semicircular lips having a U-shaped cross-section, the elongated strip having a width essentially equal to a diameter of a top of a cylindrical beverage can, the elongated strip dimensioned for placement over the top of the beverage can with the inwardly curved lips snapidly engaging a rim of the top of the beverage can;

a rubber plug having a generally circular configuration, the plug having an upper surface and a lower surface, the plug secured to a lower surface of the elongated strip inwardly of one of the opposing end portions whereby when the elongated strip is secured to the top of the beverage can, the plug is sealingly disposed over an opening in the top; and a plastic lifting tab integrally formed with and extending outwardly from a center of one of the inwardly curved lips adjacent to the rubber plug, the lifting tab facilitating engagement and disengagement of the device from the beverage can.

* * * * *